United States Patent [19]

Spivak

[11] 3,995,248

[45] Nov. 30, 1976

[54] VARIABLE RESISTANCE DEVICE

[75] Inventor: David Spivak, New York, N.Y.

[73] Assignee: Inventures, Inc., New York, N.Y.

[22] Filed: June 14, 1974

[21] Appl. No.: 479,360

[52] U.S. Cl. ..... 338/157; 73/518; 338/202

[51] Int. Cl.[2] ..... H01C 10/28

[58] Field of Search ..... 338/143, 144, 145, 146, 338/147, 148, 149, 157, 158, 174, 202; 200/166; 333/82; 323/75; 116/129; 336/139; 73/518

[56] References Cited

UNITED STATES PATENTS

| | | | |
|---|---|---|---|
| 1,883,098 | 10/1932 | Templeton | 338/157 X |
| 2,141,770 | 12/1938 | Solomon | 338/147 |
| 2,368,710 | 2/1945 | Hessey | 338/157 X |
| 2,492,727 | 12/1949 | Ballard | 338/157 X |
| 2,761,045 | 8/1956 | Matthew | 338/158 |
| 2,888,653 | 5/1959 | Jaffe | 338/147 X |
| 3,076,161 | 1/1963 | Charles | 338/157 |
| 3,257,606 | 6/1966 | Grant | 338/143 X |
| 3,382,474 | 5/1968 | Doering, Jr. | 338/174 |
| 3,534,194 | 10/1970 | Speller | 338/157 X |
| 3,539,962 | 11/1970 | Erban | 338/157 X |

*Primary Examiner*—C. L. Albritton
*Attorney, Agent, or Firm*—Auslander & Thomas

[57] ABSTRACT

A variable resistor includes a low-friction contact such as a ball or roller, which may be stabilized by a magnet or trough.

4 Claims, 2 Drawing Figures

VARIABLE RESISTANCE DEVICE

The present invention relates to an improved variable resistance device.

In the past, it has been desirable to have variable resistance devices, free of friction, as between the various contacting parts. The purpose of this was ease of operating the device and for greater accuracy.

In some applications, such freedom of function and accuracy also assisted in obtaining miniaturization where desired.

Insofar as variable resistors were concerned, the problems of function, accuracy and even miniaturization were substantially the same whether applied to rheostats or potentiometers.

In U.S. Pat. No. 3,290,567, parallel longitudinal spaced apart contacts included a ball adapted to ride in the groove between the contact strip and resistor strip of a potentiometer. This configuration of the 3,290,567 patent, while forming a variable low friction contact, has made no provision for accuracy in the use of its resistance variance characteristics since the contact is a free-moving ball.

Accuracy and ease of movement may be an important factor in special applications where, for instance, a current output is desired to be in proportion to a certain function, as in my U.S. Pat. No. 3,662,328, a variable signal proportional to the speed of a vehicle is employed.

According to the present invention, a resistance device of low friction is disclosed.

Although such novel feature or features believed to be characteristic of the invention are pointed out in the claims, the invention and the manner in which it may be carried out, may be further understood by reference to the description following and the accompanying drawings.

Referring now to the figures in greater detail, where like reference numbers denote like parts in the various figures.

Figure 1:
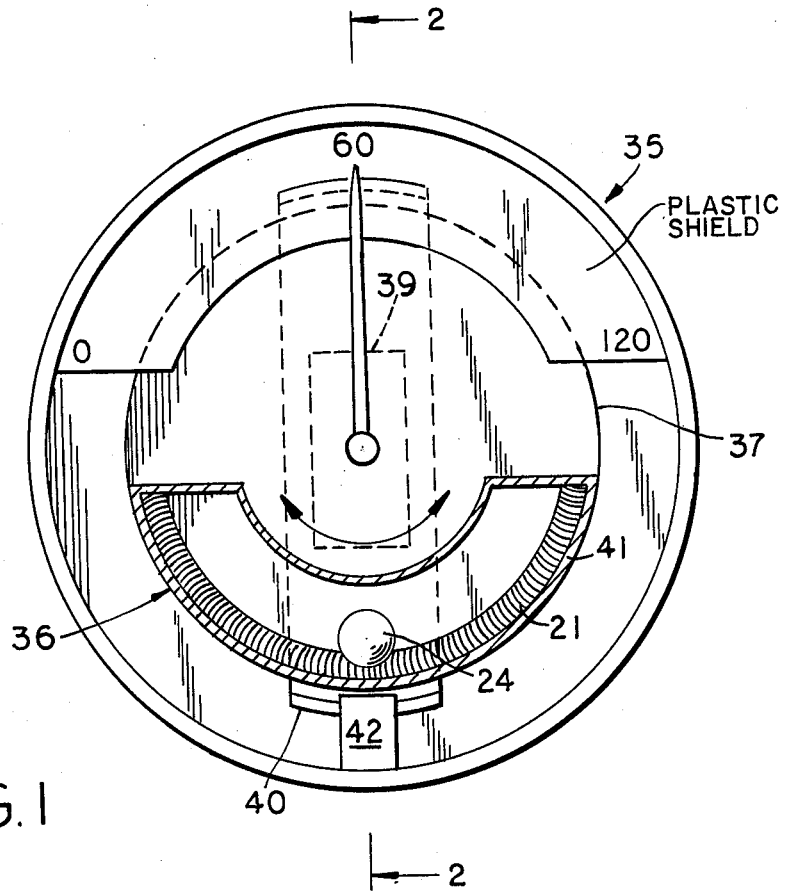
FIG. 1 is a front elevation of a variable resistor device of the present invention used in conjunction with a speedometer, partially in section.
Figure 2:
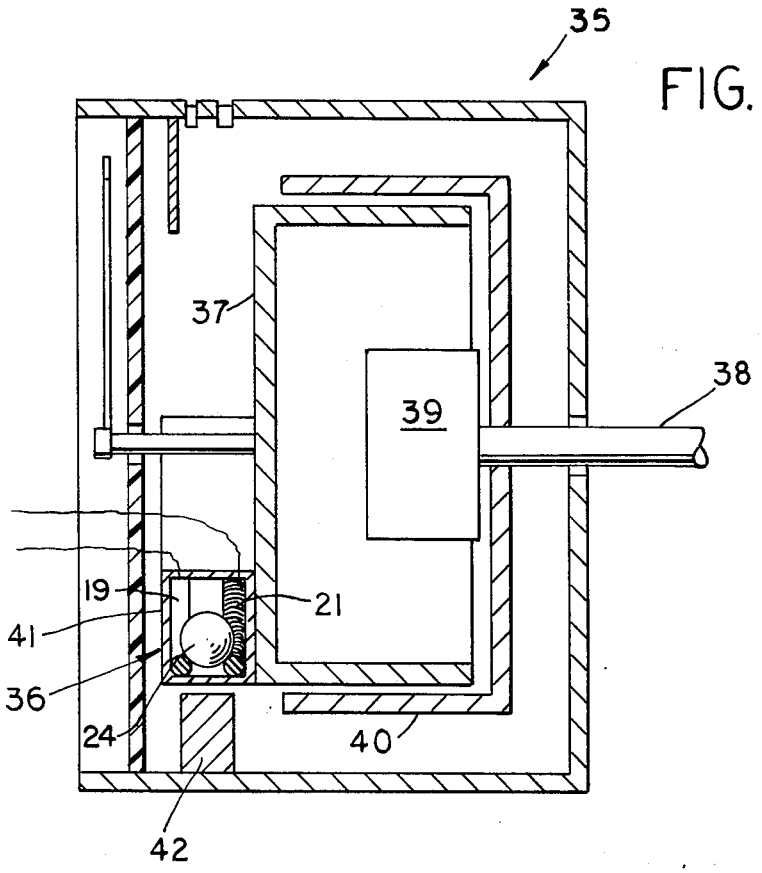
FIG. 2 is a section of FIG. 1 at lines 2—2.

In FIGS. 1 and 2 a specific speedometer 35 application of the variable resistor 36 of the present invention is shown. In this application, the variable resistor 36 is attached to the speed cup 37 of the speedometer 35. The speed cup 37 is swung to indicate speed by the rotation of the cable 38 which includes a permanent magnet 39 inside the speed cup 37 and a field plate 40 outside the speed cup 37.

The variable resistor 36 mounted on the front of the speed cup 37 has a housing 41 of a substantially semicircular configuration, and conductor wire 19 and resistance wire 21 spaced apart to form a track for a conductor ball 24. The conductor ball 24 is stabilized by a magnet 42 so that it remained in position as the speed cup 37 moves back and forth.

In operation, a substantially frictionless variable resistance track of the contact 24 covers the entire range of resistance of the variable resistors 36.

The free ball contact 24 held against movement by a magnet 42, achieves a very low friction contact.

The variable resistor 36 employs a ball 24 conductor wire 19 and resistor wire 21 with a magnet 42. The variable resistor 36 is in a semicircular housing 41. In this configuration, movement of the housing 41 with the movement of the speed cup 37 can produce a linear output of electricity in proportion to the speed of a vehicle.

The terms and expressions which are employed are used as terms of description; it is recognized, though, that various modifications are possible.

Having thus described certain forms of the invention in some detail, what is claimed is:

1. A low friction variable resistor device in a speedometer, said speedometer including a speed cup, an elongated curvilinear resistance element, said resistance element having a substantially semicircular shape, conductance means, said resistance element and conductance means supported on said speed cup, roller means, said roller means being conductive, said roller means adapted to roll within the inner circumference of said resistance element in a path between said resistance element and said conductance means and in contact with each, and said resistance element and conductance means moveable with said speed cup.

2. The low-friction variable resistance device of claim 1 including fixed magnetic means, said fixed magnetic means fixed beneath said resistance element, said fixed magnetic means adapted to stabilize said rolling means.

3. The low-friction variable resistance device of claim 1 wherein said rolling means is a ball.

4. The low-friction variable resistance device of claim 1 wherein said rolling means is moveable in a track longitudinal to said resistance element and said conductance means.

* * * * *